US011125127B2

(12) United States Patent
Grois et al.

(10) Patent No.: US 11,125,127 B2
(45) Date of Patent: Sep. 21, 2021

(54) INTERNAL COMBUSTION ENGINE WITH CRANKCASE VENTILATION

(71) Applicant: Bayerische Motoren Werke Aktiengesellschaft, Munich (DE)

(72) Inventors: Peter Grois, Karlsfeld (DE); Eberhard Hilper, Unterfoehring (DE); Marc Mueller, Gronsdorf (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 0 days.

(21) Appl. No.: 16/865,543

(22) Filed: May 4, 2020

(65) Prior Publication Data

US 2020/0263576 A1 Aug. 20, 2020

Related U.S. Application Data

(63) Continuation of application No. PCT/EP2018/074844, filed on Sep. 14, 2018.

(30) Foreign Application Priority Data

Nov. 7, 2017 (DE) ..... 10 2017 219 702.1

(51) Int. Cl.
*F01M 13/00* (2006.01)
*F01M 1/02* (2006.01)
*F01M 11/00* (2006.01)

(52) U.S. Cl.
CPC ..... *F01M 13/0011* (2013.01); *F01M 1/02* (2013.01); *F01M 11/0004* (2013.01); *F01M 2013/0044* (2013.01)

(58) Field of Classification Search
CPC .. F01M 13/0011; F01M 1/02; F01M 11/0004; F01M 2013/0044; F01M 13/022; F01M 2011/0041; F01M 2011/0083
See application file for complete search history.

(56) References Cited

U.S. PATENT DOCUMENTS 4,674,457 A 6/1987 Berger et al.
5,078,233 A 1/1992 Oetting et al.
(Continued)

FOREIGN PATENT DOCUMENTS

DE 37 14 886 C2 9/1988
DE 40 37 803 A1 8/1991
(Continued)

OTHER PUBLICATIONS

International Search Report (PCT/ISA/210) issued in PCT Application No. PCT/EP2018/074844 dated Dec. 19, 2018 with English translation (five (5) pages).
(Continued)

*Primary Examiner* — Jacob M Amick
(74) *Attorney, Agent, or Firm* — Crowell & Moring LLP

(57) ABSTRACT

An internal combustion engine having a crankcase with a base and an oil tank, wherein a first connection between the crankcase and the oil tank is formed with a first valve, which is open in the direction from the crankcase to the oil tank and closed in the opposite direction, and a second connection between the crankcase and the oil tank is formed with a second valve, which is open in the direction from the oil tank to the crankcase and is closed in the opposite direction. The first valve is arranged on the base of the crankcase and the second valve is arranged above the first valve.

8 Claims, 1 Drawing Sheet

(56) References Cited

U.S. PATENT DOCUMENTS

| | | | | |
|---|---|---|---|---|
| 5,709,185 | A | 1/1998 | Aizawa et al. | |
| 6,148,807 | A * | 11/2000 | Hazen | F01M 1/04 123/572 |
| 2004/0079299 | A1 | 4/2004 | White et al. | |
| 2010/0199941 | A1 | 8/2010 | Steiner et al. | |
| 2016/0040795 | A1* | 2/2016 | Roys | F04B 53/18 415/113 |

FOREIGN PATENT DOCUMENTS

| | | | |
|---|---|---|---|
| DE | 195 44 533 | C2 | 5/1998 |
| DE | 100 43 795 | A1 | 3/2002 |
| DE | 10 2008 012 904 | A1 | 9/2009 |
| DE | 10 2009 000 657 | A1 | 8/2010 |
| DE | 10 2013 007 520 | A1 | 11/2014 |
| DE | 10 2013 021 557 | A1 | 6/2015 |
| EP | 1 384 865 | A1 | 1/2004 |
| GB | 1 227 287 | A | 4/1971 |
| JP | 2005-171777 | A | 6/2005 |
| JP | 2007-187133 | A | 7/2007 |

OTHER PUBLICATIONS

Written Opinion (PCT/ISA/237) issued in PCT Application No. PCT/EP2018/074844 dated Dec. 19, 2018 (six (6) pages).
German-language Office Action issued in German Application No. 10 2017 219 702.1 dated Aug. 21, 2018 (five (5) pages).

* cited by examiner

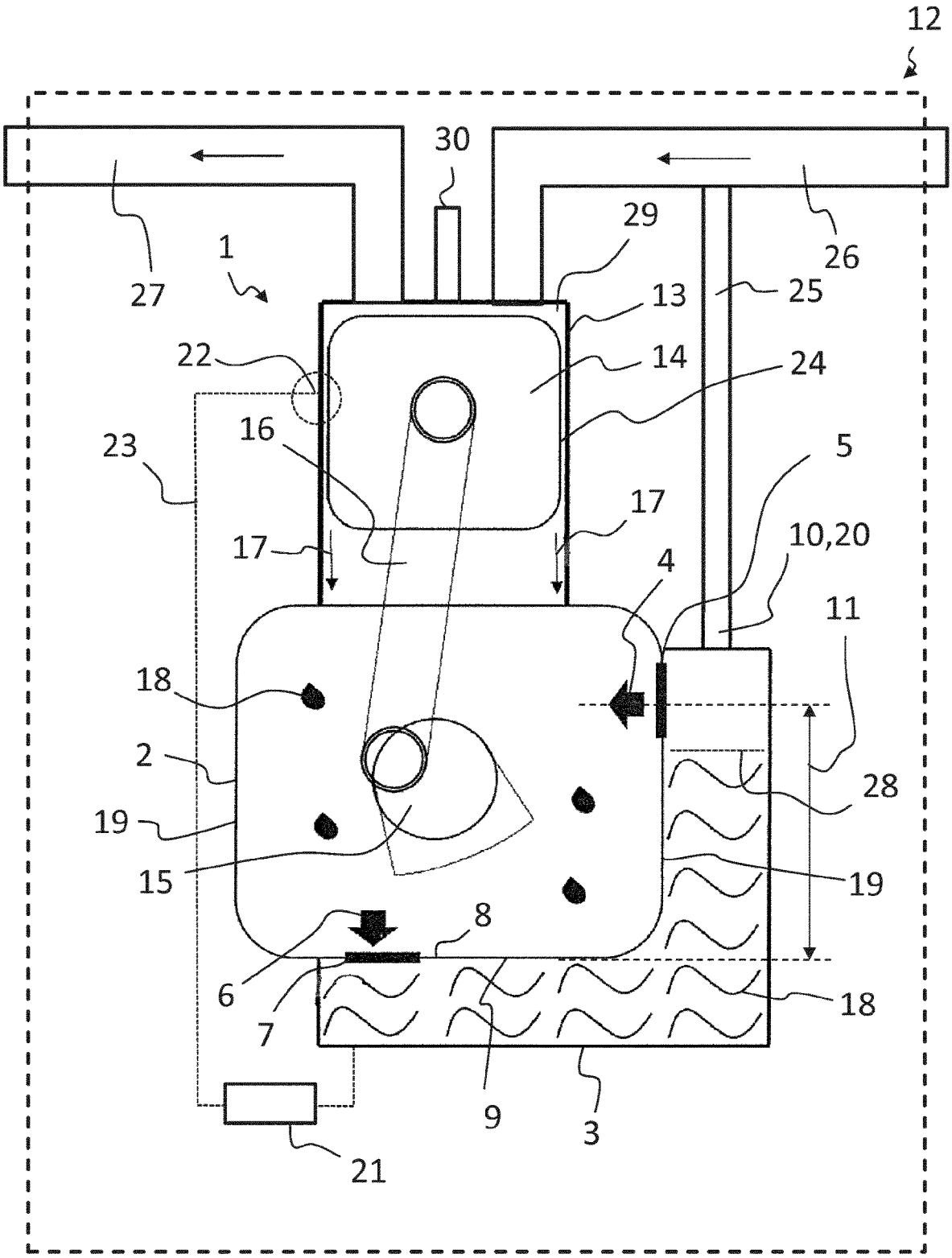
12
30
29
26
27
1
13
25
22
14
24
16
23
5
17
17
10,20
4
11
18
2
28
19
15
19
8
6
18
7
9
3
21

INTERNAL COMBUSTION ENGINE WITH CRANKCASE VENTILATION

CROSS REFERENCE TO RELATED APPLICATIONS

This application is a continuation of PCT International Application No. PCT/EP2018/074844, filed Sep. 14, 2018, which claims priority under 35 U.S.C. § 119 from German Patent Application No. 10 2017 219 702.1, filed Nov. 7, 2017, the entire disclosures of which are herein expressly incorporated by reference.

BACKGROUND AND SUMMARY OF THE INVENTION

The invention relates to an internal combustion engine with a crankcase ventilation system.

In internal combustion engines with cylinders which drive a crankshaft, crankcase gases (what are known as blow-by gases) usually occur in the crankcase, in which the crankshaft is situated. Blow-by gases of this type are produced by virtue of the fact that exhaust gas and partially also unburned mixture comprising air and fuel exits from the combustion chamber through a gap between the piston and the cylinder. Said blow-by gas contains many pollutants. This is due, in particular, to the fact that said blow-by gas has not been subjected to the customary exhaust gas purification. It is customary to discharge the blow-by gas from the crankcase and to feed it again in a targeted manner to the combustion in the combustion chambers of the internal combustion engine. For this purpose, what are known as crankcase breathers or crankcase ventilation systems are known which discharge the gas from the crankcase and feed it again to the intake side of the internal combustion engine. In the case of internal combustion engines, the crankcase normally additionally also serves to collect lubricants (in particular, oil). Lubricants enter into the crankcase, in particular, by way of main bearings and connecting rod bearings, and other lubricating points.

The lubrication of an internal combustion engine is generally an important aspect of the operation of the internal combustion engine. Lubricant (oil) has to be transported as a rule to critical points during the operation of an internal combustion engine, in order for frictionless operation of the internal combustion engine to be realized. Oil pumps are required for this purpose, which oil pumps deliver the lubricant (oil) from a central collecting point to those points of the internal combustion engine, at which lubrication is required.

Proceeding herefrom, it is an object of the present invention to provide an internal combustion engine which is particularly advantageous with regard to the crankcase breather and the lubrication.

This and other objects are achieved by way of an internal combustion engine in accordance with the claimed invention.

An internal combustion engine having a crankcase with a bottom and an oil tank is to be described here, a first connection being formed between the crankcase and the oil tank by way of a first valve which is open in the direction from the crankcase to the oil tank and closes in the opposite direction, and a second connection being formed between the crankcase and the oil tank by way of a second valve which opens in the direction from the oil tank to the crankcase and closes in the opposite direction. The first valve is arranged on the bottom of the crankcase, and the second valve is arranged above the first valve.

The internal combustion engine is an internal combustion engine with cylindrical combustion chambers, in which pistons can be moved up and down by way of combustion in the combustion chamber. The movement of the pistons is transmitted via connecting rods to a crankshaft which is situated in the crankcase and is mounted rotatably there. The mechanical energy which is generated by the internal combustion engine can be tapped off at the crankshaft. As a rule, a (very small) gap exists between a wall of the cylinder of the at least one combustion chamber of the internal combustion engine and the piston, through which gap the (so-called) blow-by gas and/or lubricant (in particular, oil) can exit from the lubrication region between the piston and the wall of the cylinder and from the combustion chamber into the crankcase.

For this reason, a mixture of lubricant (oil) and gas (blow-by gas) which cannot be defined unambiguously collects in the crankcase. If there is not sufficient space for an oil sump/oil tank at a sufficient spacing below the crankcase, the oil has to be pumped into an oil tank. If the oil sump lies below the crankcase, this is called the wet sump principle. If an oil tank, into which the oil is pumped, does not lie below the crankcase, but rather next to it, for example, this is called the dry sump principle. The internal combustion engine which is described here is, in particular, an internal combustion engine which follows the dry sump principle.

In order for it to be possible for the oil to be used again for the correct lubrication of the internal combustion engine at lubricating points, it is necessary for the oil to be collected in a defined container. The defined container is an oil tank. As a result of the design variant which is described here, a first connection exists, through which oil which normally collects on the bottom of the crankcase on account of its weight can exit downward into an oil tank. As a result of the volumetric flow of the oil from the crankcase into the oil tank, a pressure difference exists in the oil tank and the crankcase, which pressure difference has to be equalized. The second valve serves for this purpose. The second valve is preferably arranged so far above the first valve that it is arranged in the oil tank above a customary (main) oil level. For this reason, superfluous gas passes through the second connection and the second valve from the oil tank into the crankcase. As a result, a pressure equalization takes place between the oil tank and the crankcase. A type of circuit flow of oil and gas through the oil tank and the crankcase is produced by way of the interaction of the crankcase of the first connection of the oil tank and the second connection, the flow direction of which circuit flow is defined by the first valve and the second valve.

As a result of that design variant of an internal combustion engine which is described here, additional pumps, which pump oil from the crankcase and collect it in an oil tank, can be dispensed with.

As a result of the movement of the pistons in the cylinders, the internal volume of the crankcase is regularly increased and decreased. Therefore, a pump is formed together with the first valve and the second valve. In the case of the reduction of the internal volume of the crankcase by way of a downward movement of the piston, oil is pressed (downward) into the oil tank by way of the first valve. In the case of the increase of the internal volume of the crankcase by way of an upward movement of the piston, the gas is sucked from the oil tank by way of the second valve.

Oil is additionally pressed by way of the second valve into the oil tank by way of blow-by gas which enters into the crankcase. Depending on the pressure level in the combustion chambers of the internal combustion engine, a different quantity of blow-by gas occurs. Under full load of the internal combustion engine, the quantity of blow-by gas is greatest. In the case of idling (when substantially no combustion takes place in the combustion chambers), the quantity of blow-by gas is smallest. The blow-by gas as a pressure source, in order to drive oil into the oil tank, is therefore (merely) an additional effect which can be utilized here.

As a result of the rotation of the crankshaft within the crankcase, local pressure fluctuations fundamentally (always) occur in the crankcase during operation of the internal combustion engine. The crankshaft normally has a great cross section and a great surface area, and it therefore moves gas to and fro within the crankcase. In the case of the internal combustion engine which is described, said pressure fluctuations are utilized in a particularly advantageous way to induce or to configure the described circuit flow of oil and gas in the crankcase and the oil tank. Additional pumps can be dispensed with here, as has already been described.

The variant is particularly advantageous, in the case of which the first valve is arranged on the bottom of the crankcase. The bottom means, in particular, a lower face of the crankcase. The bottom is preferably a planar, horizontal face (in relation to a geodetic orientation). Moreover, the crankcase is also extended in a vertical direction. In this respect, side walls of the crankcase also exist in a manner which is demarcated with respect to the bottom, the demarcation between the bottom and the side walls normally being identified by way of a transition region which can be configured, for example, with a radius of a crankcase wall. The first valve is particularly preferably arranged at the lowest point of the crankcase and is oriented substantially horizontally in relation to the geodetic direction, with the result that oil which is present in the crankcase is guided directly onto the first valve with a very small resistance.

The internal combustion engine is advantageous, furthermore, if the crankcase and the oil tank have a common dividing wall which separates the crankcase and the oil tank from one another. A common dividing wall of this type can be formed, for example, by a sheet metal element which configures both the bottom of the crankcase and a section or an entire side wall of the crankcase. The oil tank is preferably attached to the crankcase. As a result of a common dividing wall of the crankcase and the oil tank, material is firstly saved because, as a result, only one dividing wall is necessary and not two separate walls which in each case delimit the crankcase and the oil tank. Moreover, the common dividing wall also has the advantage that satisfactory thermal transport occurs between the crankcase and the oil tank and, in particular, no heat losses or only small heat losses are produced, by way of which the oil cools down.

It is advantageous, furthermore, if the first valve is a diaphragm valve.

It is advantageous, moreover, if the second valve is a diaphragm valve.

Diaphragm valves are very particularly suitable for configuring the first valve and/or the second valve. Diaphragm valves can be of flat configuration and adapt ideally to the shape of a dividing wall between the oil tank and the crankcase. Moreover, diaphragm valves can be adapted particularly satisfactorily in the direction of the dividing wall to the respective position of the first valve and/or the second valve.

The second valve is preferably of (somewhat) more easy-running configuration than the first valve. Air (predominantly) passes through the second valve. Oil (predominantly) passes through the first valve. An air flow fundamentally generates lower forces than an oil flow. Therefore, the first and the second valve are preferably adapted (in each case) to the forces which act by way of the respective fluid (oil/air).

Moreover, a diaphragm valve is a type of valve which is of particularly simple construction and is very robust.

Furthermore, the internal combustion engine is advantageous if the oil tank has a breather which is arranged at the top.

The breather which is arranged at the top makes it possible to discharge superfluous gas from the oil tank, the fact that the breather is arranged at the top ensuring that as little oil as possible exits from the oil tank, but rather only superfluous gas exits therefrom. The breather is preferably arranged (certainly) above an oil level in the oil tank, the breather preferably even being arranged so high that it is ensured, independently of the operating situation of the internal combustion engine, that oil can never exit at a higher level than the location of the breather in the oil tank. An overall volume of the oil tank (optionally with incorporation of the volume of the crankcase) is preferably so great that the entire oil which is situated in an oil circuit of the internal combustion engine can be received and an oil level nevertheless lies below the breather. The time of the highest oil level is normally the time of the internal combustion engine being at a standstill, because all the oil in the internal combustion engine then collects in the oil tank. The oil tank is normally that component of the internal combustion engine which is to be arranged at the very bottom (in relation to the geodetic orientation).

It is particularly preferred if the oil tank has a breather which is arranged at the top. The breather is preferably arranged at the uppermost point of the oil tank.

It is particularly preferred, furthermore, if the breather of the oil tank is at the same time the crankcase breather of the crankcase of the internal combustion engine.

In this embodiment, the breather of the oil tank is the (only) opening of the crankcase, through which blow-by gas can exit from the crankcase. The gas which exits from the breather or the crankcase breather is preferably fed to the air filter of the internal combustion engine via a return line.

The internal combustion engine is advantageous, furthermore, if the first valve and the second valve are at a vertical spacing from one another of at least 10 centimeters. The vertical spacing is preferably even at least 15 centimeters or even at least 20 centimeters.

A vertical spacing of this magnitude can achieve a situation where only gas and no oil passes through the second valve from the oil tank back into the crankcase. Here, a vertical spacing means, in particular, a spacing in a vertical direction parallel to the geodetic orientation. It is as a rule not necessary that the vertical spacing is so great that the entire oil in the oil circuit of the internal combustion engine is received below the second valve. The desired effect of a circuit flow of oil through the first valve with a return flow of gas through the second valve is as a rule intended to occur during operation of the internal combustion engine. During operation of the internal combustion engine, the oil is present in a distributed manner in the internal combustion engine and has not collected in the oil tank. To this extent, the second valve can be arranged considerably closer to the first valve than the breather in relation to a geodetic orientation.

The internal combustion engine particularly preferably also has a suction pump for the removal of oil from the oil tank and for the delivery of the oil to at least one lubricating point of the internal combustion engine.

A lubricating point, to which the suction pump delivers oil, can be, for example, a cylinder lining surface, along which a cylinder of the internal combustion engine moves during operation of the internal combustion engine.

The suction pump is preferably the only pump for the delivery of oil in the internal combustion engine.

A motor vehicle having an internal combustion engine according to the present invention is also to be described here.

Other objects, advantages and novel features of the present invention will become apparent from the following detailed description of one or more preferred embodiments when considered in conjunction with the accompanying drawings.

BRIEF DESCRIPTION OF THE DRAWINGS

FIG. 1 is a schematic diagram of an internal combustion engine according to an exemplary embodiment of the invention.

DETAILED DESCRIPTION OF THE DRAWINGS

FIG. 1 shows an internal combustion engine 1 with a combustion chamber 29 which can be enlarged and decreased by a piston 14 which can be moved up and down in a cylinder 13. The internal combustion engine 1 sucks in air via an intake line 26. Fuel can be fed to the combustion chamber via an injector 30, with the result that ignitable mixture comprising fuel and air is produced in the combustion chamber 29. After the ignitable mixture has burned in the combustion chamber 29, it is discharged via the exhaust gas line 27. The internal combustion engine 1 is preferably an internal combustion engine in a motor vehicle 12. It can also be, however, an internal combustion engine 1 in any other desired application.

The internal combustion engine 1 has a crankshaft 15 which is driven via connecting rods 16 by the cylinders of the internal combustion engine. The crankshaft 15 is situated in a crankcase 2. An oil tank 3 adjoins the crankcase 2. The oil tank 3 is connected to the crankcase 2 via a first connection 4 and via a second connection 6. A first valve 5 which can be opened only in the direction from the oil tank 3 to the crankcase 2 exists in the first connection 4. A second valve 7 which can be opened only in a direction from the crankcase 2 to the oil tank 3 exists in the second connection 6. The first connection 4 and the second connection 6 with the first valve 5 and the second valve 7 are situated in a dividing wall 9 which separates the crankcase 2 from the oil tank 3. The dividing wall 9 is, in particular, a common boundary wall of the crankcase 2 and the oil tank 3. The dividing wall 9 forms a bottom 8 of the crankcase and at least one side wall 19 of the crankcase. The first connection 4 and the first valve 5 are situated in the side wall 19 of the dividing wall 9. The second connection 6 and the second valve 7 are situated in a bottom wall 8 of the dividing wall 9. The first connection 4 and the first valve 5 and the second connection 6 and the second valve 7, respectively, are at a vertical spacing 11 from one another which is, for example, 10 cm or more. Blow-by gas 17 and oil 18 can pass from the combustion chambers 29 of the internal combustion engine 1 through gaps 24 between the cylinder 13 and the piston 14. Therefore, blow-by gas 17 and oil 18 form an (undefined) mixture within the crankcase 2. The oil 18 collects in the lower region of the crankcase 2, because said oil 18 has a greater weight than the blow-by gas 17. The oil 18 can pass via the second valve 7 and the second connection 6 from the crankcase 2 into the oil tank 3. At the same time, a pressure equalization can occur by way of a gas passage through the first connection and first valve from the oil tank 3 into the crankcase 2. On its upper side, the oil tank 3 has a breather 10 which at the same time forms the (only) crankcase breather 20 of the crankcase 2. Blow-by gas 17 which is to be conveyed out of the crankcase 2 has to exit through the breather 10 or the crankcase breather 20. The blow-by gas can be fed from the crankcase breather 20 via a return line 25 to the intake line 26 of the internal combustion engine. The breather 10 and the first connection 4 and the first valve 5 are all preferably arranged above an oil level 28 which can be set as a maximum in the oil tank 3. In order to lubricate the internal combustion engine 1, oil 18 can be removed from the oil tank 3 with the aid of a suction pump 21 which can feed the oil via a line system 23 to any desired lubricating points 22 of the internal combustion engine 1, only one lubricating point 22 being indicated here by way of example.

The internal combustion engine which is described here is advantageous in comparison with internal combustion engines with conventional means for the delivery of oil from the crankcase into an oil tank. The internal combustion engine becomes more reliable and less expensive by virtue of the fact that additional pumps can be dispensed with. Friction can be reduced by way of the omission of an additional pump for the delivery of oil from the crankcase into an oil tank. This increases the economic efficiency of the internal combustion engine.

LIST OF DESIGNATIONS

1 Internal combustion engine
2 Crankcase
3 Oil tank
4 First connection
5 First valve
6 Second connection
7 Second valve
8 Bottom
9 Dividing wall
10 Breather
11 Vertical spacing
12 Motor vehicle
13 Cylinder
14 Piston
15 Crankshaft
16 Connecting rod
17 Blow-by gas
18 Oil
19 Side wall
20 Crankcase breather
21 Suction pump
22 Lubricating point
23 Line system
24 Gap
25 Return line
26 Intake line
27 Exhaust gas line
28 Oil level
29 Combustion chamber
30 Injector The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. An internal combustion engine, comprising:

a crankcase with a bottom and an oil tank;

a first connection formed between the crankcase and the oil tank by way of a first valve which is open in the direction from the oil tank to the crankcase and closes in the opposite direction, wherein a pressure equalization between the crankcase and the oil tank occurs as a result of passage of a gas from the oil tank into the crankcase via the first valve, a second connection formed between the crankcase and the oil tank by way of a second valve which opens in the direction from the crankcase to the oil tank and closes in the opposite direction, wherein the second valve is arranged on the bottom of the crankcase, and the first valve is arranged above the second valve, and a suction pump for removal of oil from the oil tank and for delivery of the oil via a line to a lubricating point of the internal combustion engine.

2. The internal combustion engine according to claim 1, wherein the crankcase and the oil tank have a common dividing wall which separates the crankcase and the oil tank from one another.

3. The internal combustion engine according to claim 1, wherein the first valve is a diaphragm valve.

4. The internal combustion engine according to claim 3, wherein the second valve is a diaphragm valve.

5. The internal combustion engine according to claim 1, wherein the oil tank has a breather which is arranged at a top thereof.

6. The internal combustion engine according to claim 5, wherein the breather of the oil tank is at the same time the crankcase breather of the crankcase of the internal combustion engine.

7. The internal combustion engine according to claim 1, wherein the first valve and the second valve are at a vertical spacing from one another of at least 10 centimeters.

8. A motor vehicle comprising an internal combustion engine according to claim 1.

* * * * *